United States Patent [19]

Pike

[11] 4,278,067

[45] Jul. 14, 1981

[54] FURNACE

[76] Inventor: Clinton B. Pike, 21 Willow Rd., Apt. 14, Menlo Park, Calif. 94025

[21] Appl. No.: 21,163

[22] Filed: Mar. 15, 1979

[30] Foreign Application Priority Data

Jun. 28, 1978 [NZ] New Zealand ..... 186719

[51] Int. Cl.[3] ..... F23H 13/00; F24H 3/06

[52] U.S. Cl. ..... 126/152 R; 126/103; 126/110 AA; 126/112

[58] Field of Search ..... 126/163 R, 163 A, 152 R, 126/152 B, 110 AA, 112, 103

[56] References Cited

U.S. PATENT DOCUMENTS

| | | | |
|---|---|---|---|
| 277,754 | 5/1883 | Lucas | 126/152 R |
| 951,703 | 3/1910 | Sawyer | 126/152 R |
| 973,879 | 10/1910 | Promenshenkel et al. | 126/112 |
| 1,497,490 | 6/1924 | Dullman | 126/152 R |
| 1,609,788 | 12/1926 | Anderson | 126/112 |
| 1,765,201 | 6/1930 | Borgeson | 126/112 |
| 2,151,642 | 3/1939 | Rose | 126/112 |
| 2,647,506 | 8/1953 | Heiman | 126/110 AA |
| 2,773,675 | 12/1956 | Wyckoff | 126/110 AA |
| 3,067,735 | 12/1962 | Albert | 126/110 AA |
| 3,358,675 | 12/1967 | Voges | 126/110 AA |

*Primary Examiner*—Daniel J. O'Connor
*Attorney, Agent, or Firm*—Marshall C. Gregory

[57] ABSTRACT

An improved downdraft furnace wherein two combustion grates are used, with the lower one being maintained completely covered with glowing coals, which totally oxidize combustion gases and particles passing through, with the result that the exhaust is free of smoke.

2 Claims, 2 Drawing Figures

FIG_1
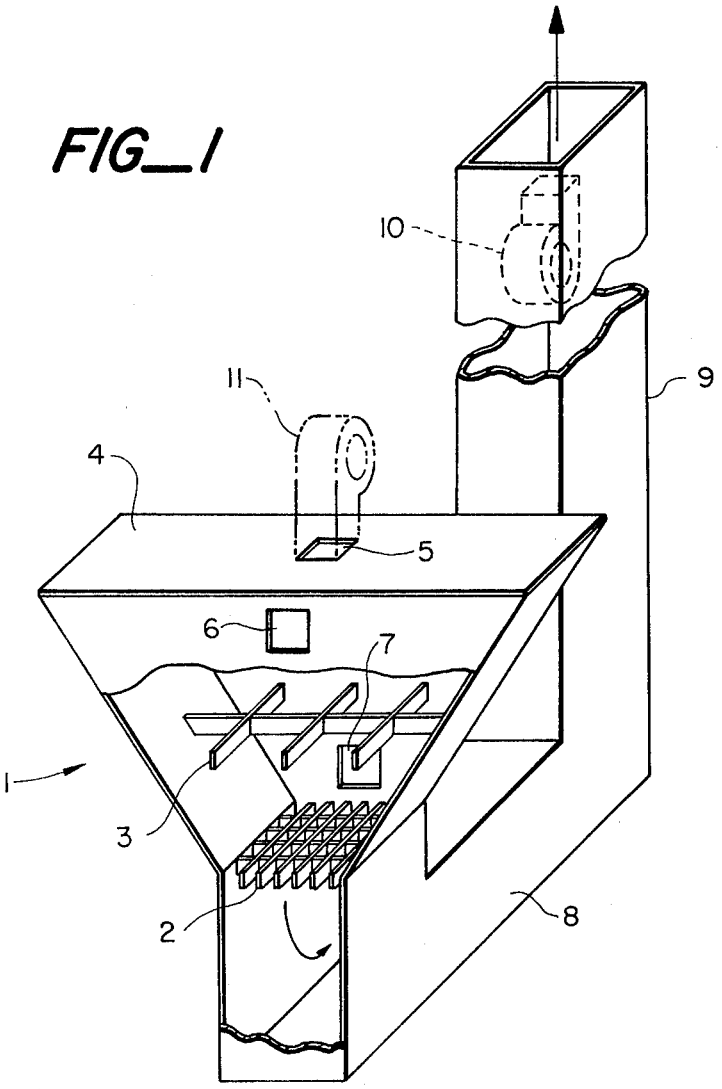
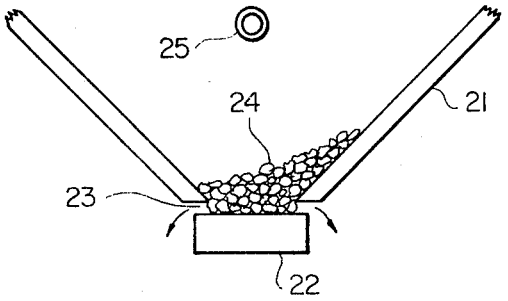
FIG_2

FURNACE

BACKGROUND

1. Field of the Invention

This invention relates to furnaces and heating devices. Specifically in this case an object of the invention is to provide complete combustion of the material used as fuel therein, so that no dirty smoke results from the fire.

2. Description of the Prior Art

Furnaces have been built in many forms in the past. A basic form involves an arrangement wherein solid fuel is burned on a grate. Depending on the actual fuel used, and its particulate size or granularity, combustion of fuel resting on a single grate is almost invariably incomplete, resulting in unburned particles, which produce smoke and ash. When the particles or pieces of fuel are reduced to a size smaller than the openings in the grate, they will fall through into an ash pit or fire pit where they will probably smolder or burn even less completely.

In a typical updraft furnace, where the combustion air flows up through the layer of fuel on the grate, the fuel will burn unevenly so that unburned particles of fuel are carried off out the chimney or flue, resulting in incomplete combustion and creating dirty, dark smoke.

Particular forms of furnaces have been devised to attempt to provide more complete and efficient combustion of the fuel, for the purpose primarily of achieving greater heat production by the more efficient use of the fuel, and also in some cases with the additional purpose of reducing smoke.

For example, a U.S. Patent to Roëll, issued in 1907 (U.S. Pat. No. 843,105) was entitled Smoke Consuming Heater. In this invention after the fire is burning, air is led through passages around the firepot to heat it (the air) further, and, per the teaching of the patent, increase the heat output and reduce the smoke in the exhaust.

An earlier patent (U.S. Pat. No. 464,425, 1891, to C. R. Burr) involves an improved furnace which is intended to achieve complete combustion of the fuel by the use of dual grates, one above the other, the upper one intended to serve as a fuel feed for the lower. In this design, the grate bars are hollow and diverge from front to rear. Intake air passes partly through the upper grate's hollow bars, and is led down into the space between the grates, to provide a downward draft through the fuel on the lower grate into the ashpit below and to a following combustion chamber. Part of the intake air also passes through the hollow bars of the lower grate and mixes subsequently with the other intake combustion air. Fuel is put on the upper grate, the bars of which diverge from front to rear, providing a greater spacing between the bars at the front than at the rear. During combustion, the fuel on the upper grate must be raked or agitated so that it falls through the grate onto the lower one, supplying it with fuel already burning or pre-heated. In this design, it does not appear that the means chosen will assure that the lower grate is completely covered with fuel, so that unburned gas can pass through the grate and final combustion must occur in the ashpit or its associated chamber. Such combustion is unlikely to be complete enough to prevent the emission of a significant amount of smoke.

Another U.S. Pat. No. 1,954,923, to Eichhorn (1934), describes a furnace which may be operated in either a downdraft or updraft mode. This, however, is a single grate furnace with a shelf below the grate having an opening into an ashpit, so that fuel falling through the grate will be caught on the shelf or fall into the ashpit, in both cases to smolder and burn incompletely, with smoke resulting. While Eichhorn provides for auxiliary air passages to provide pre-heated air for the downdraft mode, the patent states that in the downdraft mode an upper damper should be partially open, permitting accumulated smoke to be drawn off from above the coal bed into a smoke box, from which it apparently exhausts.

In equipment so basic as a furnace, many other designs for both updraft and downdraft operation have been proposed.

SUMMARY OF THE INVENTION

A primary object of the present invention is to provide a furnace in which fuel is completely burned and no dirty smoke emits.

The invention consists in a furnace comprising a furnace housing in which are a coarse upper fuel support structure or grate, a finer lower fuel support structure or grate, an air inlet above the upper fuel support, and an outlet for combustion gases below the lower fuel support. The furnace housing converges downwardly, being in the shape of a hopper, so that the fine lower fuel support is of smaller area than the coarse upper one which receives the fuel. This results in allowing partially burned fuel to fall through the openings in the upper support, but be held by the finer lower support structure, forming an unbroken layer of glowing coals on the lower fuel support, this layer being maintained by fuel from the upper fuel support as fresh fuel is added thereto. There will be much smoke in the space between the grates, but it will be completely oxidized as it passes through the hot coals on the lower fuel support, and no more combustion will occur thereafter.

BRIEF DESCRIPTION OF THE DRAWINGS

FIG. 1 is a perspective view of one preferred form of the present invention, part of the wall being broken away to show interior arrangement in a simplified manner.

FIG. 2 is a sectional view through the hopper to show a type of fuel support structure for high temperature use.

DESCRIPTION OF THE PREFERRED EMBODIMENT

The basic form of the furnace is shown in FIG. 1, disclosing a housing 1 in the shape of a hopper with side walls which converge towards the bottom. At the bottom of hopper 1 is positioned lower fuel support structure 2, which will be referred to for brevity as a grate, constructed to provide fine apertures for the passage of combustion gases, and to support fuel of relatively fine particulate size. In FIG. 1 this fuel support grate is shown as a grid of relatively fine size. Above lower grate 2, still within hopper 1, is an upper fuel support structure 3, also referred to for brevity as a grate, of construction similar to lower grate 2, but with larger apertures and less restricted passages through it, so that partially burned fuel may fall through it to come to rest on lower grate 2.

At the top of hopper 1 is shown a lid or cover 4, which is partially or entirely removable. At least one air intake aperture for combustion air is provided in the cover, as at 5, or in the upper part of the hopper (1) walls, as at 6, or possibly both. It may be desirable or necessary, and is within the concept of the invention, to provide one or more air intake apertures 7 in the walls of hopper 1 between the grates for augmenting inlet combustion air, in addition to apertures 5 and 6, as they may be provided.

The bottom of hopper 1 communicates with an exhaust duct 8 below the lower fuel grate 2, which duct leads to a chimney or flue 9, of height as required to provide a sufficient draft for efficient fuel combustion.

Fuel is introduced into hopper 1 so that it comes to rest or catches on upper grate 3. There it is ignited and as it burns it breaks up and pieces fall through the coarse openings in grate 3 and come to rest on lower fuel support grate 2. Thus a pile or layer of hot embers collects on lower grate 2, the fall of which is layer of hot embers collects on lower grate 2, the fall of which is channelled by the convergence of the walls of hopper 1 so that an unbroken layer of hot coals covers the entire surface of lower grate 2. These hot embers completely burn any smoke which comes down from upper grate 3 to lower grate 2, tending to totally oxidize all gases and unburned particles within the lower bed of coals, and requiring no further combustion below grate 2. If a hole is allowed to develop in the bed of coals on grate 2, then oxidization will not be total, and some smoke may result.

FIG. 2 discloses how this channeling effect provides the complete layer of coals, and also shows a particular variation in construction of lower grate 2 for very high temperature operation. Grate 2 may be a metal grid of fine size, as shown in FIG. 1, or it may be closely spaced metal bars, or it may be necessary for very high temperatures to construct it of fire brick or other refractory materials. Disclosed here is such a structure, with walls 21 (of hopper 1) converging down towards a fire brick fuel support 22, spaced with fine openings 23 which allow passage of gases (and the fall of ash) from the combustion of coal bed 24. The upper fuel grate may be of conventional grid or bar design, or refractory material, and is indicated in FIG. 2 by showing a support bar 25 for a grate or supporting structure not shown in detail.

The downward draft required within the furnace is ensured by creating an updraft in chimney 9, either by establishing an initial combustion there, or more practicably by using a fan or other draft-inducing means 10 to provide an updraft in chimney 9, thus providing the downward airflow necessary down through hopper 1, upper fuel grate 3, lower fuel support 2, exhaust duct 8, then up through flue or chimney 9. In actual construction of the furnace, other draft-inducing means 11 may be used at any aperture 5, 6, or 7, or at all such apertures, as well as for creating exhaust airflow through duct 8 and chimney 9.

In tests of the concept employed, successful combustion without smoke was achieved with green leaves placed on upper grate 2, the gases emerging from the chimney being completely clear.

I have described herein the preferable embodiment of my invention. It should be clear that within the bounds of that description, minor variations and modifications may be made without departing from what is claimed.

I claim as my invention:

1. A downdraft furnace comprising:

a furnace housing;

over said housing a cover or lid, all or part of which may be removable;

within said housing a coarse upper fuel supporting structure or grate on which combustion of large pieces of fuel is initiated;

below said upper fuel grate a finer lower fuel supporting structure or grate on which combustion is completed of fuel which has partially burned on the upper grate and fallen through to the lower grate, and through which burning fuel gases from the first combustion must pass; there being at least one air inlet for combustion air supply in the portion of the furnace above the upper grate; and below the lower grate a duct to convey exhaust gases to a chimney or flue;

wherein the housing is in the shape of a hopper; the coarse upper grate is within the hopper; the lower grate is at the base of the hopper and centered with respect to the upper grate; wherein there is at least one additional air inlet for combustion air in the housing walls between the upper and lower fuel grates.

2. A downdraft furnace comprising:

a furnace housing;

over said housing a cover or lid, all or part of which may be removable;

within said housing a coarse upper fuel supporting structure or grate on which combustion of large pieces of fuel is initiated;

below said upper grate a finer lower fuel supporting structure or grate on which combustion is completed of fuel which has partially burned on the upper grate and fallen through to the finer lower grate; there being at least one air inlet for combustion air supply in the portion of the furnace above the upper grate; and below the lower grate a duct to convey exhaust gases to a chimney or flue wherein the housing is in the shape of a hopper; the coarse upper grate is within the hopper; the lower finer grate is at the base of the hopper and centered with respect to the upper grate; and said lower grate is sufficiently smaller in surface area than the upper grate so that it will be completely covered by the burning fuel falling from the upper grate; wherein there is at least one additional air inlet for combustion air in the housing walls between the upper and lower fuel grates.

* * * * *